US005193689A

United States Patent [19]

Hoppe

[11] Patent Number: 5,193,689

[45] Date of Patent: Mar. 16, 1993

[54] SIEVE

[75] Inventor: Kurt Hoppe, Hilden, Fed. Rep. of Germany

[73] Assignees: Hein, Lehmann Trenn- und Fordertechnik GmbH, Dusseldorf; Isenmann Siebe GmbH, Karlsruhe, both of Fed. Rep. of Germany

[21] Appl. No.: 823,566

[22] Filed: Jan. 22, 1992

[30] Foreign Application Priority Data

Jan. 22, 1991 [DE] Fed. Rep. of Germany ..... 4101710

[51] Int. Cl.[5] ..... B07B 1/28

[52] U.S. Cl. ..... 209/323; 209/365.3; 209/405

[58] Field of Search ..... 209/323, 365.3, 365.1, 209/405, 409, 381

[56] References Cited

U.S. PATENT DOCUMENTS

| | | | |
|---|---|---|---|
| 44,974 | 11/1864 | Rice | 209/323 |
| 612,521 | 10/1898 | Landes et al. | 209/405 |
| 979,685 | 12/1910 | Mumford | 209/323 |
| 2,831,576 | 4/1958 | Wehner | 209/365.3 |

FOREIGN PATENT DOCUMENTS

| | | | |
|---|---|---|---|
| 1206372 | 12/1965 | Fed. Rep. of Germany . | |
| 720437 | 12/1954 | United Kingdom | 209/323 |

*Primary Examiner*—H. Grant Skaggs
*Attorney, Agent, or Firm*—Herbert Dubno; Andrew Wilford

[57] ABSTRACT

A sieve has a rigid outer frame having longitudinally extending side beams and transverse end beams bridging the side beams, at least one cross bar in the frame extending generally parallel to the end beams, a mesh fixed to the cross bar and end beams, and spring elements resiliently supporting the cross bar on the frame for movement relative thereto. A drive reciprocates the outer frame at least generally parallel to the side beams and thereby also moves the cross bar. Thus the spring elements will transmit the movement of the outer frame to the inner cross bar with some delay. The mesh secured to the outer frame and cross bar will therefore be subdivided into panels that will be alternately tightened and slackened for excellent agitation of the material being sifted.

5 Claims, 3 Drawing Sheets

SIEVE

FIELD OF THE INVENTION

The present invention relates to a sieve. More particularly this invention concerns a sieve whose mesh is carried on relatively movable supports.

BACKGROUND OF THE INVENTION

A standard sieve has a generally horizontal mesh, which term here is intended to cover any perforated sheet whether woven or not, whose ends at least are fixed to a frame that is reciprocated with at least some horizontal component. Thus particulate material placed on the mesh will be bounced about and those particles smaller than the mesh openings will fall through.

In order to maximize movement of the particulate material being graded it is known from German patent document 1,206,372 filed Sep. 26, 1964 by A. Wehner to fix the mesh to a plurality of horizontal and parallel bars each fixed to one of two frames with every other bar secured to the same frame. A drive is connected to and between the two frames to move them oppositely so that the mesh surface is subdivided into a plurality of different panels that move alternately, with half of the panels being pulled taut while the others are becoming slack and vice versa. Such a system is fairly complicated to build and its drive is quite expensive. Furthermore it is impossible to retrofit this system to an existing sieve whose mesh is held in a single panel that is moved all together.

It has been suggested to somehow mount some support elements of the mesh independently so that they do not have to be independently driven, but no practical system has been made. Such an arrangement has been proposed in combination with a system having removable mesh panels but, once again, no practical realization is known.

OBJECTS OF THE INVENTION

It is therefore an object of the present invention to provide an improved sieve.

Another object is the provision of such an improved sieve which overcomes the above-given disadvantages, that is which provides for good sifting action and that is nonetheless of simple construction.

A further object is to provide an improved multipanel sieve system which can be retrofitted to an existing single-panel sieve.

SUMMARY OF THE INVENTION

A sieve according to the invention has a rigid outer frame having longitudinally extending side beams and transverse end beams bridging the side beams, at least one cross bar in the frame extending generally parallel to the end beams, a mesh fixed to the cross bar and end beams, and spring elements resiliently supporting the cross bar on the frame for movement relative thereto. A drive reciprocates the outer frame at least generally parallel to the side beams and thereby also moves the cross bar.

Thus the spring elements will transmit the movement of the outer frame to the inner cross bar with some delay. The mesh secured to the outer frame and cross bar will therefore be subdivided into panels that will be alternately tightened and slackened for excellent agitation of the material being sifted. Such an arrangement is fairly simple and can easily be maintained and serviced.

According to the invention an inner frame has a pair of side bars extending generally parallel to but spaced transversely inward of the side beams of the outer frame and a pair of such cross bars bridging the side bars. In this case the spring elements are attached between each side bar and the respective side beam. The outer frame further has a central cross beam parallel to and between the end beams and to which the mesh is fixed and this cross beam is formed with longitudinally throughgoing slots into which the side bars fit loosely. In order to fit to existing outer frames with cross beams, the side bars can have central U-shaped portions that engage under the cross beam.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
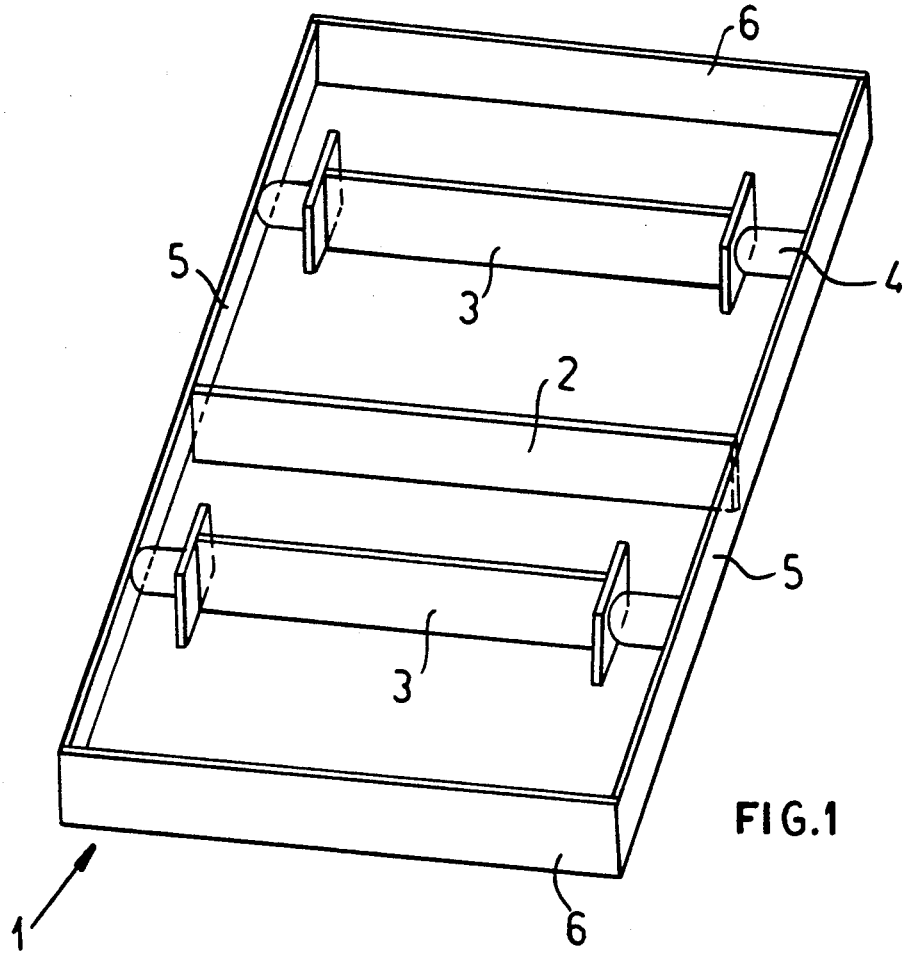
FIG. 1 is a perspective view of a sieve according to this invention.
Figure 1A:
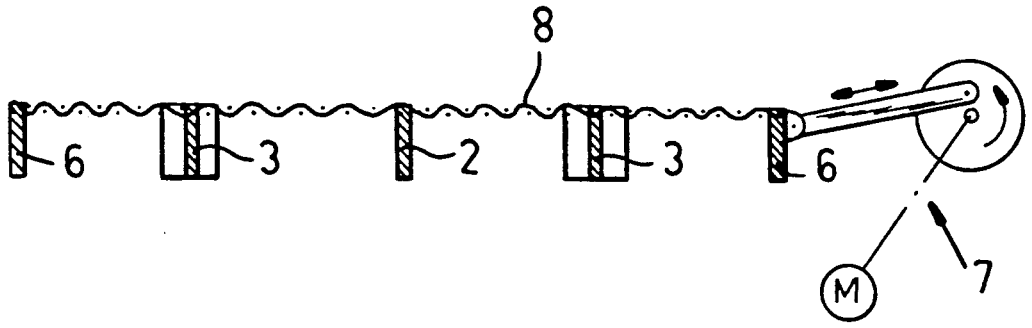
FIG. 1A is a partly diagrammatic axial section through the sieve of FIG. 1.

As seen in FIGS. 1 and 1A a sieve according to this invention has an outer frame 1 formed by longitudinally extending and normally horizontal side beams 5 and transversely extending and normally also horizontal end beams 6. A central cross beam 2 parallel to the end beams 6 bridges the side beams 5. A mesh 8 is fixed by cleats to the top edges of the beams 2 and 6, with some slack left in it. A drive assembly 7 is connected to the frame 1 to shake it horizontally on slide mounts not shown here.

According to the invention short cross bars 3 parallel to the beams 2 and 6 are provided between each end beam 6 and the central beam 2 and are supported by elastomeric mounts 4 here constituted as rubber blocks on the side beams 5. The mesh 8 is also cleated to the upper edges of these bars 4 but not to the upper edges of the side beams 5. Thus as the frame 1 is reciprocated by the drive this motion will be transmitted via the mounts 4 to the bars 3. The inherent delay in transmission of movement to the bars 3 will cause them to move at the same period as the frame 1 but with a time delay or phase shift, causing the individual panels defined between the beams 2 and 6 on one end and the beams 3 on the other to get taut and loose. The result is much improved sifting action.

Figure 2:
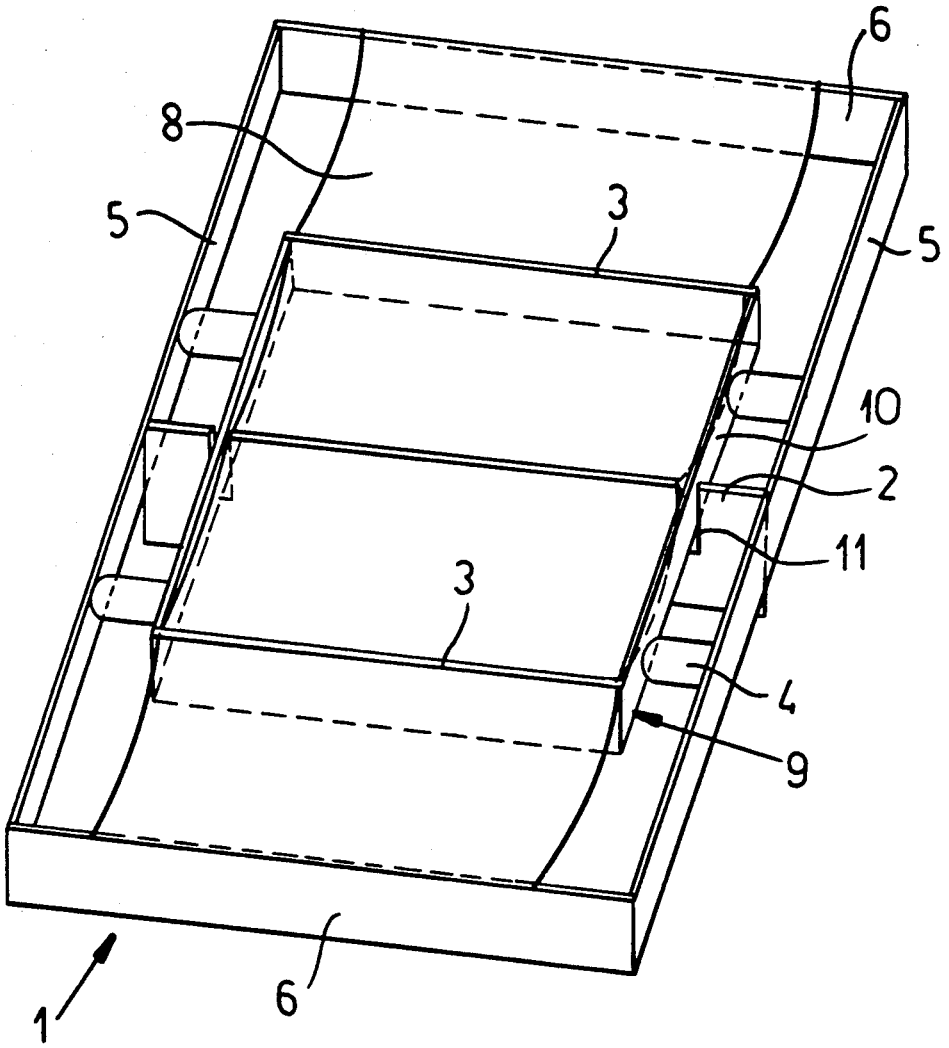
FIG. 2 is a view like FIG. 1 of another sieve according to the invention.

In FIG. 2 a rectangular central frame 9 is formed by two such cross bars joined by longitudinally extending side bars 10 accommodated in slots 11 in the central cross beam 2. This frame 9 is supported by four such mounts 4 on the side beams 5. Thus here the mesh 8 is subdivided into four panels like that of FIGS. 1 and 1A, but the two bars 3 will move jointly.

Figure 3:
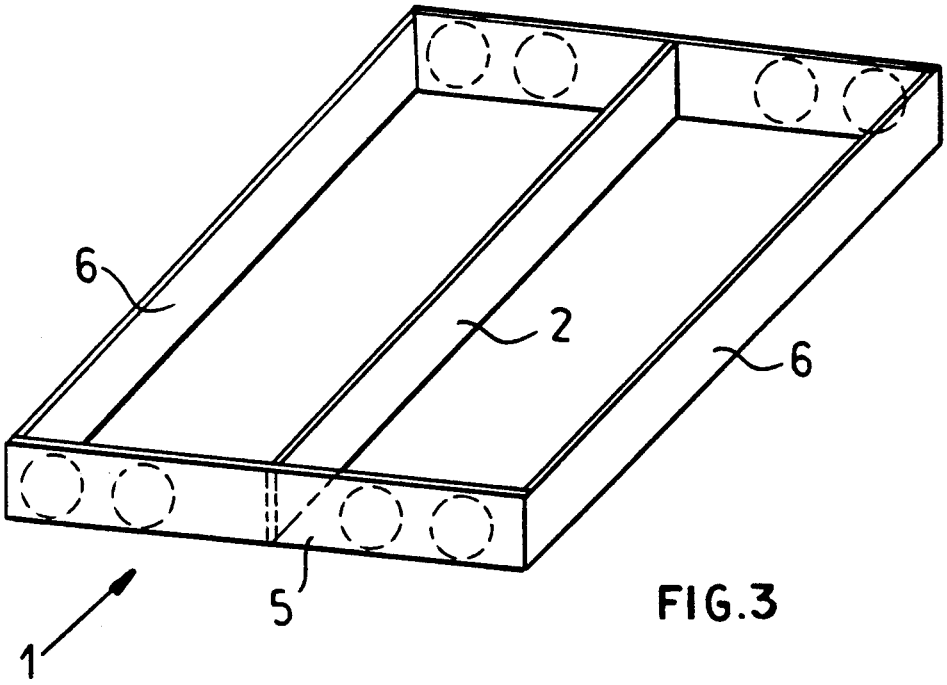
FIGS. 3 and 4 are perspective views of the outer and inner frames, respectively, of yet another sieve in accordance with this invention.
Figure 4:
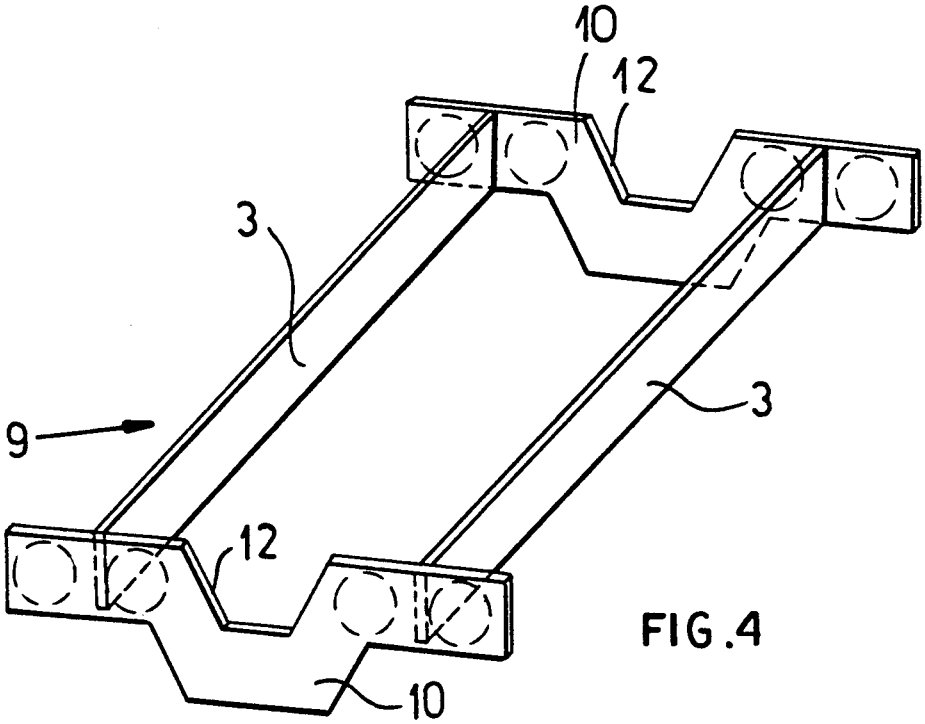

In FIGS. 3 and 4 the arrangement is substantially identical to that of FIG. 2 except that the side bars 10 are formed with central U-shaped regions 12 that can reach under the central beam 2, eliminating the need for the cutouts 11. Thus this arrangement can readily be retrofitted on an existing one-piece sieve.

I claim:

1. A sieve comprising:

a rigid outer frame having longitudinally extending side beams, transverse end beams bridging the side beams, and a central cross beam parallel to and between the end beams;

an inner frame having a pair of side bars extending generally parallel to but spaced transversely inward of the side beams of the outer frame, and a pair of cross bars bridging the side bars and extending generally parallel to the end beams;

a mesh fixed to the cross bars and end beams;

spring elements resiliently supporting the side bars on the respective side beams for movement relative thereto; and drive means for reciprocating the outer frame at least generally parallel to the side beams and thereby also moving the inner frame.

2. The sieve defined in claim 1 wherein the cross beam is formed with longitudinally throughgoing slots into which the side bars fit loosely.

3. The sieve defined in claim 1 wherein the side bars have central U-shaped portions that engage under the cross beam.

4. The sieve defined in claim 1 wherein the cross bars are substantially shorter than the end beams.

5. The sieve defined in claim 4 wherein the spring elements have outer ends fixed to the side beams.

* * * * *